US010300337B2

(12) United States Patent
Nakashima

(10) Patent No.: US 10,300,337 B2
(45) Date of Patent: May 28, 2019

(54) WALKING TRAINING APPARATUS AND STATE DETERMINATION METHOD

(71) Applicant: TOYOTA JIDOSHA KABUSHIKI KAISHA, Toyota-shi (JP)

(72) Inventor: Issei Nakashima, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/459,282

(22) Filed: Mar. 15, 2017

(65) Prior Publication Data

US 2017/0312579 A1 Nov. 2, 2017

(30) Foreign Application Priority Data

Apr. 28, 2016 (JP) ..... 2016-090599

(51) Int. Cl.
*A63B 24/00* (2006.01)
*A61H 1/02* (2006.01)
(Continued)

(52) U.S. Cl.
CPC ..... *A63B 24/0087* (2013.01); *A61H 1/024* (2013.01); *A61H 1/0244* (2013.01);
(Continued)

(58) Field of Classification Search
CPC . A63B 24/00; A63B 24/0062; A63B 24/0087; A63B 21/4011; A63B 21/4035;
(Continued)

(56) References Cited

U.S. PATENT DOCUMENTS 9,713,439 B1 * 7/2017 Wu ..... A61B 5/11
2015/0012111 A1 * 1/2015 Contreras-Vidal ..... A61B 5/0476 623/25

(Continued)

FOREIGN PATENT DOCUMENTS

JP 6-269429 A 9/1994
JP 2012-213554 A 11/2012

(Continued)

OTHER PUBLICATIONS

R. Riener, et al., "Robot-Supported Spasticity Evaluation", 9th Annual Conference of the International FES Society, 2004, 3 pgs.

*Primary Examiner* — Sundhara Ganesan
(74) *Attorney, Agent, or Firm* — Oblon, McClelland, Maier & Neustadt, L.L.P.

(57) ABSTRACT

A walking training apparatus 1 includes a leg robot 2 attached to a leg of a walking trainee, a motor 261 configured to rotationally drive a knee joint 22 of the leg robot 2, a control unit 332 configured to control the motor 261 so that the motor 261 rotationally drives the knee joint 22 in a leg-idling period in a gait motion of the walking trainee, a motor torque detection unit 262 configured to detect a motor torque, the motor torque being a torque generated by the motor 261, and a determination unit 333 configured to determine whether or not the walking trainee is in a spasticity state or a rigidity state by using a value of the motor torque detected in the leg-idling period by the motor torque detection unit 262.

7 Claims, 9 Drawing Sheets

(51) Int. Cl.

| | |
|---|---|
| ***A63B 21/00*** | (2006.01) |
| ***A61H 3/00*** | (2006.01) |
| ***A63B 22/02*** | (2006.01) |
| ***A63B 23/04*** | (2006.01) |
| ***A63B 69/00*** | (2006.01) |

(52) U.S. Cl.
CPC ..... *A61H 1/0262* (2013.01); *A61H 1/0266* (2013.01); *A61H 3/008* (2013.01); *A63B 21/4011* (2015.10); *A63B 21/4035* (2015.10); *A63B 22/02* (2013.01); *A63B 23/04* (2013.01); *A63B 69/0028* (2013.01); *A61H 3/00* (2013.01); *A61H 2003/007* (2013.01); *A61H 2201/0192* (2013.01); *A61H 2201/1215* (2013.01); *A61H 2201/1481* (2013.01); *A61H 2201/164* (2013.01); *A61H 2201/165* (2013.01); *A61H 2201/1635* (2013.01); *A61H 2201/1642* (2013.01); *A61H 2201/1652* (2013.01); *A61H 2201/1676* (2013.01); *A61H 2201/5043* (2013.01); *A61H 2201/5061* (2013.01); *A61H 2201/5069* (2013.01); *A61H 2201/5097* (2013.01); *A63B 2024/0093* (2013.01); *A63B 2220/54* (2013.01)

(58) Field of Classification Search
CPC ..... A63B 22/02; A63B 23/04; A63B 2220/54; A63B 69/0028; A61H 1/0262; A61H 1/024; A61H 1/0244; A61H 1/0266; A61H 3/00; A61H 3/008; A61H 2201/0192; A61H 2201/1481; A61H 2201/1635; A61H 2201/164; A61H 2201/165; A61H 2201/1676; A61H 2201/5043; A61H 2201/5069; A61H 2201/1215; A61H 2201/1642; A61H 2201/1652; A61H 2201/5061
See application file for complete search history.

(56) References Cited

U.S. PATENT DOCUMENTS

| | | | | |
|---|---|---|---|---|
| 2016/0331557 | A1* | 11/2016 | Tong | A61F 2/6607 |
| 2017/0027803 | A1* | 2/2017 | Agrawal | A61B 5/6828 |

FOREIGN PATENT DOCUMENTS

| | | | |
|---|---|---|---|
| JP | 2015-144787 | A | 8/2015 |
| JP | 2015-164451 | A | 9/2015 |
| WO | WO 2011/145465 | A1 | 11/2011 |
| WO | WO 2014/208772 | A1 | 12/2014 |

* cited by examiner

WALKING TRAINING APPARATUS AND STATE DETERMINATION METHOD

CROSS REFERENCE TO RELATED APPLICATIONS

This application is based upon and claims the benefit of priority from Japanese patent application No. 2016-090599, filed on Apr. 28, 2016, the disclosure of which is incorporated herein in its entirety by reference.

BACKGROUND OF THE INVENTION

1. Field of the Invention

The present invention relates to a walking training apparatus by which a walking trainee does a walking training. In particular, the present invention relates to a technique for determining whether or not a walking trainee is in a spasticity state or a rigidity state in a walking training apparatus.

2. Description of Related Art

A walking training apparatus by which a walking trainee does a walking training with a leg robot attached to his/her leg has been known. However, when the walking trainee is in a spasticity state or in a rigidity state, a satisfactory training effect cannot be obtained even though the walking trainee has performed a walking training. The spasticity state and the rigidity state are states in which a muscle is tense and stiffened, and they are common to hemiplegic persons having a paralyzed leg caused by a stroke or the like. Further, while spasticity is a voluntary movement disorder, rigidity is an involuntary movement disorder.

In recent years, a technique for determining whether a person is in a spasticity state or a rigidity state has been proposed. For example, Riener R et al., "Robot-Supported Spasticity Evaluation", 9th Annual Conference of the International FES Society, September 2004 (hereinafter referred to as "Non-patent literature 1") proposes a technique for determining whether a patient is in a spasticity state or not.

SUMMARY OF THE INVENTION

Incidentally, recently there has been a demand that it be determinable whether or not a walking trainee is in a spasticity state or a rigidity state while the walking trainee is performing a walking training.

However, the technique disclosed in Non-patent literature 1 determines whether a patient is in a spasticity state in a state in which the patient is lifting both legs. In other words, the technique disclosed in Non-patent literature 1 determines whether a patient is in a spasticity state that differs from ordinary walking in which the patient (or his/her leg) receives a reactive force from a floor, and thus cannot determine the spasticity state of the patient while he/she is performing a walking training.

The present invention has been made in view of the above-described circumstance and provides a walking training apparatus and a state determination method capable of determining whether or not a walking trainee is in a spasticity state or a rigidity state while the walking trainee is performing a walking training.

To achieve the above-described object, a first exemplary aspect of the present invention is a walking training apparatus including:

a leg robot attached to a leg of a walking trainee;

a motor configured to rotationally drive a knee joint of the leg robot;

control means for controlling the motor so that the motor rotationally drives the knee joint in a leg-idling period in a gait motion of the walking trainee;

motor torque detection means for detecting a motor torque, the motor torque being a torque generated by the motor; and determination means for determining whether or not the walking trainee is in a spasticity state or a rigidity state by using a value of the motor torque detected by the motor torque detection means in the leg-idling period.

To achieve the above-described object, another exemplary aspect of the present invention is a state determination method for determining whether or not a walking trainee is in a spasticity state or a rigidity state in a walking training apparatus by which the walking trainee does a walking training with a leg robot attached to a leg of the walking trainee, the state determination method including:

controlling a motor so that the motor rotationally drives a knee joint of the leg robot in a leg-idling period in a gait motion of the walking trainee; and detecting a motor torque in the leg-idling period and determining whether or not the walking trainee is in a spasticity state or a rigidity state by using a value of the motor torque detected in the leg-idling period, the motor torque being a torque generated by the motor.

According to each of the above-described aspects, a motor torque generated by the motor configured to rotationally drive the knee joint of the leg robot is detected in a leg-idling period in a gait motion of a walking trainee and it is determined whether or not the walking trainee is in a spasticity state or a rigidity state by using a value of the detected motor torque. In this way, it is possible to determine whether or not the walking trainee is in a spasticity state or a rigidity state while the walking trainee is performing a walking training.

According to each of the above-described aspects, it is possible to provide a walking training apparatus and a state determination method capable of determining whether or not a walking trainee is in a spasticity state or a rigidity state while the walking trainee is performing a walking training.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

Exemplary embodiments according are explained hereinafter with reference to the drawings. Note that the same symbols are assigned to the same or corresponding components throughout the drawings and duplicated explanations are omitted as appropriate.

(1) First Exemplary Embodiment

Figure 1:
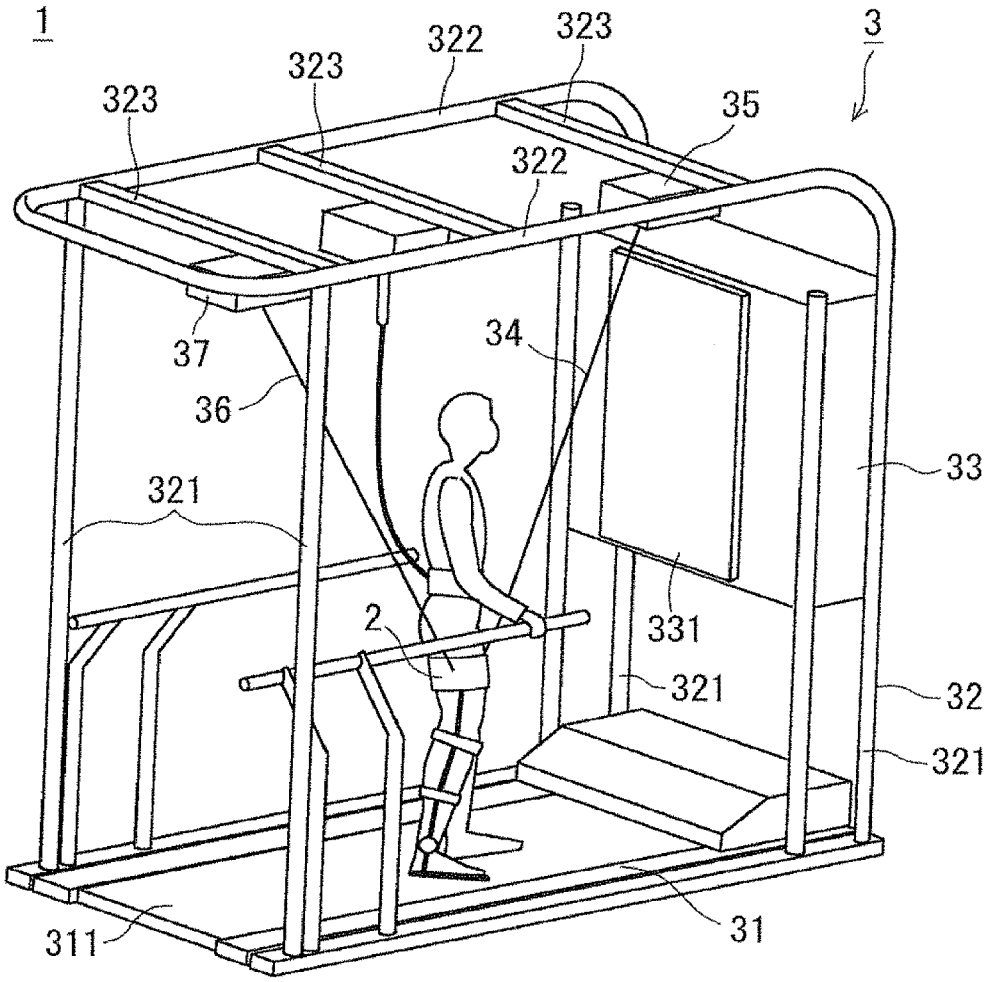
FIG. 1 is a perspective view showing an example of a schematic configuration of a walking training apparatus according to first and second exemplary embodiments of the present invention.

FIG. 1 is a perspective view showing an example of a schematic configuration of a walking training apparatus 1 according to a first exemplary embodiment of the present invention. The walking training apparatus 1 according to the first exemplary embodiment is, for example, an apparatus by which a walking trainee such as a patient having hemiplegia does a walking training. The walking training apparatus 1 includes a leg robot 2 attached to the trainee's leg and a training apparatus 3 by which the walking trainee does a walking training.

Figure 2:
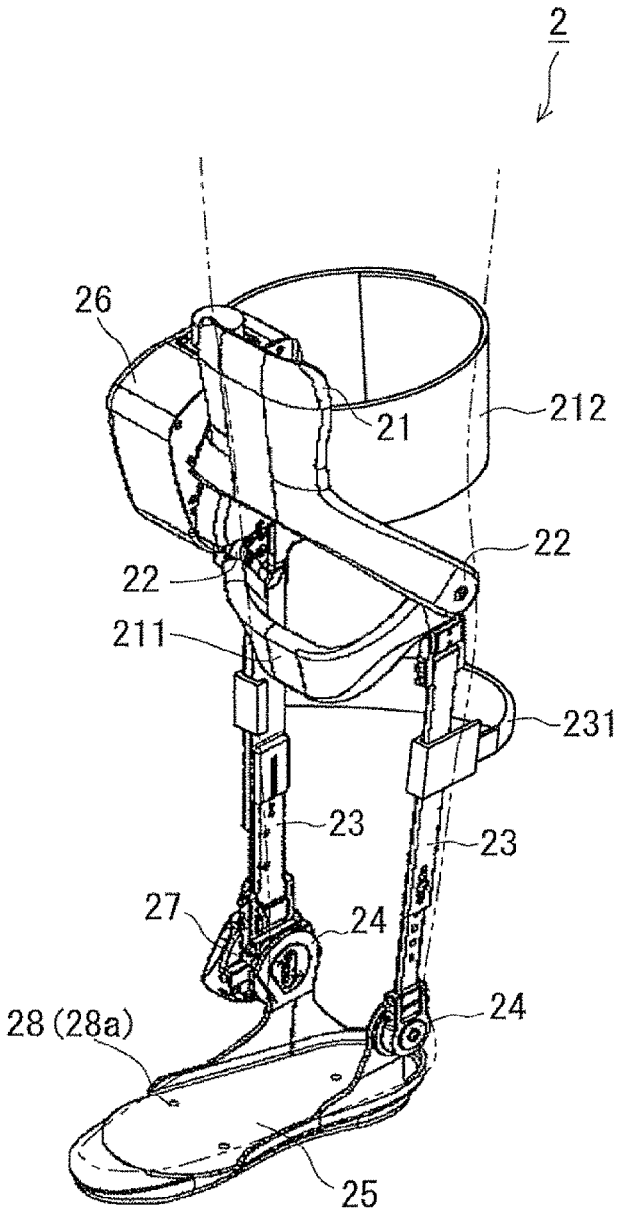
FIG. 2 shows a perspective view showing an example of a schematic configuration of a leg robot according to the first and second exemplary embodiments of the present invention.

The leg robot 2 is attached to the trainee's leg and assists the walking trainee to walk (FIG. 2). The leg robot 2 includes an upper thigh frame 21, a lower thigh frame 23 connected to the upper thigh frame 21 through a knee joint 22, a sole frame 25 connected to the lower thigh frame 23 through an ankle joint 24, a motor unit 26 that rotationally drives the knee joint 22, and an adjustment mechanism 27 that adjusts the movable range of the ankle joint 24. Note that the above-described configuration of the leg robot 2 is merely an example and the configuration of the leg robot 2 is not limited to such an example. For example, the leg robot 2 may include another motor unit that rotationally drives the ankle joint 24.

In the sole frame 25, a sole load detection unit 28 that detects a load (or a pressure) that the sole of the walking trainee receives is provided. The sole load detection unit 28 includes a plurality of load sensors 28*a* that detect a vertical load (or a vertical pressure) received by the sole of the walking trainee. In FIG. 2, a pair of load sensors 28*a* is disposed on the toe side of the sole and another pair of load sensors 28*a* is disposed on the heel side thereof. Note that the number and the positions of load sensors 28*a* can be arbitrarily determined, provided that the center of load (or the center of pressure) on the sole can be accurately obtained. Further, the place where the sole load detection unit 28 is disposed is not limited to the sole frame 25. For example, the sole load detection unit 28 may be disposed on the underside of the sole frame 25.

The upper thigh frame 21 is attached to the upper thigh of the trainee's leg and the lower thigh frame 23 is attached to the lower thigh of the trainee's leg. The upper thigh frame 21 is equipped with an upper thigh harness 212 for fixing the upper thigh frame 21 to the upper thigh of the walking trainee. By this structure, the leg robot 2 can be prevented from being displaced from the leg of the walking trainee in the crosswise direction or in the vertical direction.

The upper thigh frame 21 is equipped with a horizontally-extending (i.e., extending in the crosswise direction) and horizontally-long first frame 211 for connecting a wire 34 of a first pulling unit 35 (which is described later) to the upper thigh frame 21. The lower thigh frame 23 is equipped with a horizontally-extending (i.e., extending in the crosswise direction) and horizontally-long second frame 231 for connecting a wire 36 of a second pulling unit 37 (which is described later) to the lower thigh frame 23.

Note that the above-described connection of the first and second pulling units 35 and 37 is merely an example and the connection is not limited to such an example. For example, the wires 34 and 36 of the first and second pulling units 35 and 37 may be connected to the upper thigh harness 212.

The motor unit 26 rotationally drives the knee joint 22. The motor unit 26 includes a motor 261, a motor torque detection unit 262, and a motor rotation angle detection unit 263 (these components will be described later).

Note that the above-described configuration of the leg robot 2 is merely an example and the configuration of the leg robot 2 is not limited to such an example. Any leg robot capable of being attached to the trainee's leg and assisting him/her to walk can be applied.

The training apparatus 3 includes a treadmill 31, a frame main body 32, a control device 33, and first and second pulling units 35 and 37. The treadmill 31 rotates a ring-shaped belt 311. When the walking trainee does a walking training, the walking trainee gets on the belt 311 and walks on the belt 311 according to the movement of the belt 311.

The frame main body 32 includes two pairs of pillar frames 321 vertically disposed on the treadmill 31, a pair of lengthwise frames 322 extending in the lengthwise direction and connected to respective pillar frames 321, and three crosswise frames 323 extending in the crosswise direction and connected to each of the lengthwise frames 322. Note that the above-described configuration of the frame main body 32 is not limited to this example. The frame main body 32 may have any frame structure, provided the frame main body can appropriately fix the first and second pulling units 35 and 37 (which will be described later).

The first pulling unit 35 that pulls the wire 34 upward and forward is disposed in the front crosswise frame 323. The second pulling unit 37 that pulls the wire 36 upward and backward is disposed in the rear crosswise frame 323.

The first and second pulling units 35 and 37 include, for example, mechanisms for winding up and back the wires 34 and 36, motors that drive the mechanisms, and so on. One end of the wire 34 and one end of the wire 36, which wires are pulled by the first and second pulling units 35 and 37, respectively, are connected to the leg robot 2. The first pulling unit 35 pulls the leg robot 2 upward and forward through the wire 34. The second pulling unit 37 pulls the leg robot 2 upward and backward through the wire 36.

Although the first and second pulling units 35 and 37 control the pulling forces of the wires 34 and 36 by controlling the drive torques of the motors, the control of the pulling forces is not limited to such an example. For example, a spring member may be connected to each of the wires 34 and 36 and the pulling forces of the wires 34 and 36 may be adjusted by adjusting the elastic forces of the spring members.

The vertically upward components of the pulling forces applied by the first and second pulling units 35 and 37 relieve (or reduce) the load of the leg robot 2. Further, the horizontal components of the pulling forces applied by the first and second pulling units 35 and 37 assist the walking trainee to start swinging his/her leg. In this way, the walking load of the walking trainee during the walking training can be reduced.

Further, the frame main body 32 is equipped with a display unit 331 that displays information such as a training instruction, a training menu, and training information (such as a walking speed and biometric information).

The control device 33 controls each of the pulling forces applied by the first and second pulling units 35 and 37, the driving of the treadmill 31, and the leg robot 2. The control device 33 includes a CPU (Central Processing Unit) and a storage unit. Further, the control device 33 performs processes as the control device 33 according to the first exemplary embodiment by having the CPU execute a program(s) stored in the storage unit. That is, the program stored in the storage unit of the control device 33 includes code for causing the CPU to perform processes in the control device 33 according to the first exemplary embodiment. Note that the storage unit is formed with a storage device capable of storing the above-described program and various information items used for processes performed by the CPU. As the storage device, for example, at least one of given storage devices such as a memory and a hard disk drive may be used.

The first exemplary embodiment is characterized by the configuration for controlling the leg robot 2, while well-known techniques can be used for the configuration for controlling the first and second pulling units 35 and 37 and treadmill 31. Therefore, only the configuration for controlling the leg robot 2 is explained hereinafter and the explanation of the configuration for controlling the first and second pulling units 35 and 37 and the treadmill 31 is omitted.

Figure 3:
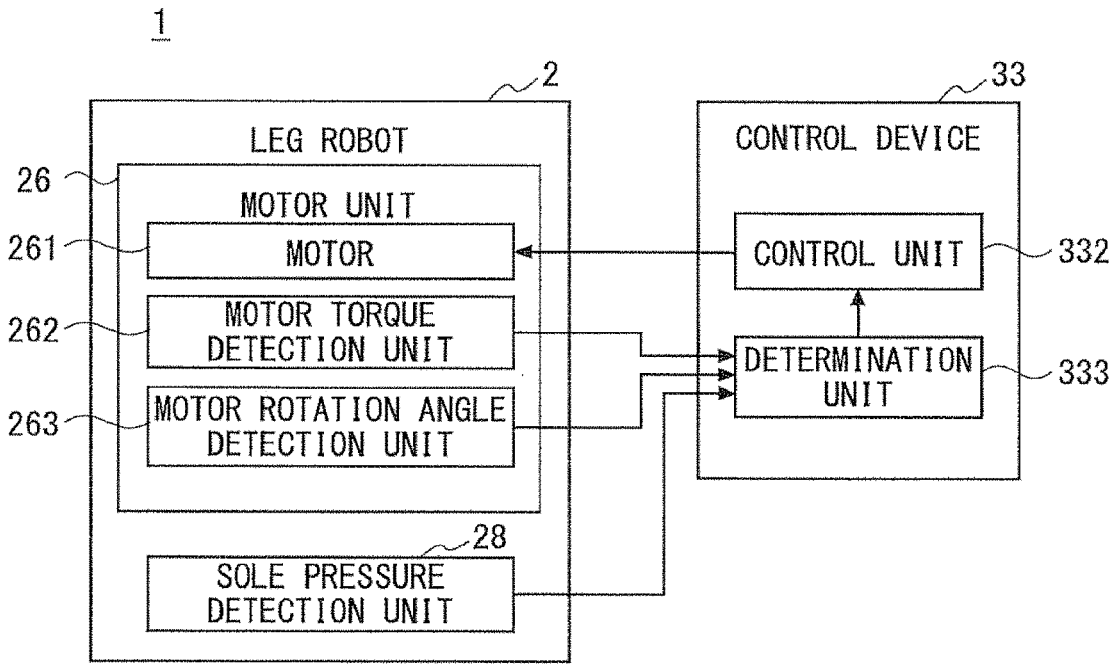
FIG. 3 is a block diagram showing an example of a schematic functional block configuration of a walking training apparatus according to the first exemplary embodiment.

FIG. 3 is a block diagram showing an example of a schematic functional block configuration of the walking training apparatus 1 according to the first exemplary embodiment. The leg robot 2 includes the above-described motor unit 26 and the sole load detection unit 28. Further, the motor unit 26 includes a motor 261, a motor torque detection unit 262, and a motor rotation angle detection unit 263. The control device 33 includes a control unit 332 and a determination unit 333. The control unit 332 and the determination unit 333 are implemented by a CPU or the like that executes a program stored in the storage unit.

The motor 261 rotationally drives the knee joint 22.

The motor torque detection unit 262 detects a motor toque [Nm] which is a torque generated by the motor 261. The motor torque detection unit 262 is connected to the control device 33 through a cable or wirelessly and outputs the value of the detected motor toque to the control device 33.

The motor rotation angle detection unit 263 detects a motor rotation angle [deg] which is a rotation angle of the motor 261. The motor rotation angle detection unit 263 is connected to the control device 33 through a cable or wirelessly and outputs the value of the detected motor rotation angle to the control device 33.

The sole load detection unit 28 detects a sole load [N] which is a load that the sole of the walking trainee receives. The sole load detection unit 28 is connected to the control device 33 through a cable or wirelessly and outputs the value of the detected sole load to the control device 33.

Note that although each of the motor torque detection unit 262, the motor rotation angle detection unit 263, and the sole load detection unit 28 outputs its detected value to the control device 33 in the above explanation, the configuration of the walking training apparatus 1 is not limited to such an example. For example, a communication unit connected to the control device 33 wirelessly or thorough a cable may be provided in the leg robot 2 and this communication unit may output values detected by the motor torque detection unit 262, the motor rotation angle detection unit 263, and sole load detection unit 28 to the control device 33.

The determination unit 333 determines a leg-idling period in a gait motion of the walking trainee by using the value of the sole load detected by the sole load detection unit 28. The leg-idling period is a period during which the trainee's leg to which the leg robot 2 is attached is floating above the floor. In the first exemplary embodiment, the determination unit 333 sets one threshold as a threshold for the sole load. Further, the determination unit 333 determines (or defines) a period from a timing when the sole load decreases beyond the threshold (a first timing) to a timing when the sole load exceeds the threshold (a second timing) as the leg-idling period.

Further, the determination unit 333 calculates the motor toque detected by the motor torque detection unit 262 as a knee drive torque [Nm] which is a torque by which the knee joint 22 is driven. Further, the determination unit 333 calculates a knee rotation angle [deg] which is a rotation angle of the knee joint 22 based on the motor rotation angle detected by the motor rotation angle detection unit 263. In the first exemplary embodiment, the knee rotation angle is defined in such a manner that when the knee is in a stretched state, the knee rotation angle is 0 [deg] and the knee rotation angle increases in the negative direction as the knee is bent. For example, when the knee is bent at a right angle, the knee rotation angle is −90 [deg]. Any given method is used to calculate the knee rotation angle from the motor rotation angle. For example, an angle by which the knee joint 22 rotates when the motor 261 makes one rotation is obtained in advance. Then, the knee rotation angle can be calculated from the motor rotation angle by using this angle. Further, the determination unit 333 calculates a knee rotation angular speed [deg/sec] which is a rotation angular speed of the knee joint 22 by using the calculated knee rotation angle. The knee rotation angular speed can be calculated by dividing the knee rotation angle by a unit time.

Further, the determination unit 333 receives an operation signal from an operation unit (not shown) that is operated by a walking trainee or a physical therapist or the like present near the walking trainee through a cable or wirelessly. Then, the determination unit 333 determines that a walking training is started, that the walking training is stopped, and so on based on the received operation signal.

In the leg-idling period in the gait motion of the walking trainee, the control unit 332 controls the motor 261 so that the motor 261 rotationally drives the knee joint 22 in order to assist the walking trainee to walk.

Specifically, the control unit 332 controls the motor 261 so that the knee rotation angle monotonously increases in an idling-leg bending period that starts when the idling-leg state starts and ends when the knee rotation angle reaches a set value in the leg-idling period in the gait motion of the walking trainee. Further, the control unit 332 controls the motor 261 so that the knee rotation angle monotonously decreases in an idling-leg stretching period that follows the idling-leg bending period, and starts when the knee rotation angle reaches the set value and ends when the idling-leg state ends in the leg-idling period. To that end, the control unit 332 constantly acquires the knee rotation angle from the determination unit 333 and controls the motor 261 so that desired knee rotation angles are achieved in the leg-idling period. Note that the control unit 332 may be notified by the determination unit 333 as to whether or not the trainee's leg is in the leg-idling period in the gait motion of the walking trainee. Alternatively, the control unit 332 may receive the value of the sole load detected by the sole load detection unit 28 and thereby determine whether or not the trainee's leg is in the leg-idling period by itself.

Figure 4:
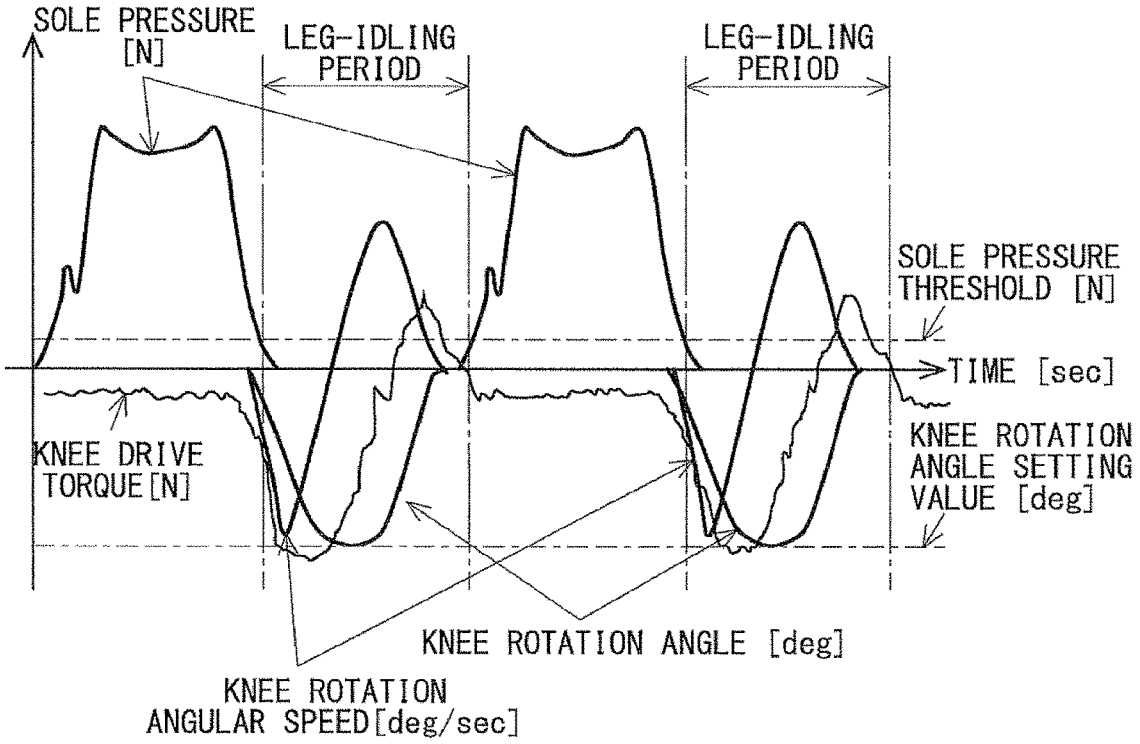
FIG. 4 is a graph showing an example of walking data in a walking training.

FIG. 4 is a graph showing an example of walking data during a walking training. Firstly, we direct our attention to the sole load. The determination unit 333 determines (or defines) a period from a timing when the sole load decreases beyond a threshold to a timing when the sole load exceeds the threshold as a leg-idling period in a gait motion of a walking trainee. Next, we direct our attention to the knee rotation angle. The control unit 332 controls the motor 261 so that the knee rotation angle monotonously increases from when the idling-leg state starts to when the knee rotation angle reaches a set value in the leg-idling period. As a result, the knee rotation angle gradually increases from 0 [deg]. Further, the control unit 332 controls the motor 261 so that the knee rotation angle monotonously decreases after the knee rotation angle reaches the set value in the leg-idling period. As a result, the knee rotation angle gradually decreases and eventually returns to 0 [deg]. Note that it is considered that an appropriate set value for the knee rotation angle may differ from one walking trainee to another.

Therefore, a different set value may be set for each walking trainee.

In the first exemplary embodiment, the determination unit 333 determines whether or not the walking trainee is in a spasticity state or a rigidity state by using values of the knee drive torque, the knee rotation angle, and the knee rotation angular speed in the period determined as the leg-idling period in the gait motion of the walking trainee.

A determination method for determining whether or not a walking trainee is in a spasticity state or a rigidity state in the determination unit 333 is explained hereinafter in a concrete manner.

It has been known that the degree of spasticity changes depending on the speed. For example, in a case where a patient is in a spasticity state, the faster they try to move a muscle of the patient by using an external force, the larger the resistance by the muscle of the patient becomes.

By using this fact, a spasticity model can be approximated by the below-shown Expression (1).

$$T_{spasticity}=D\dot{\theta} \tag{1}$$

In the Expression (1), $T_{spasticity}$ [Nm] is a knee drive torque, and $\dot{\theta}$ is a knee rotation angular speed [deg/sec].

In the expression, D is a coefficient that corresponds to a quotient of a division in which a value of the knee drive torque is a dividend and a value of the knee rotation angular speed is a divisor. A spasticity threshold (a positive value) which is a threshold for determining whether or not a walking trainee is in a spasticity state is set to this coefficient D. The determination unit 333 determines that a walking trainee is in a spasticity state when the absolute value of the value of this coefficient D exceeds the spasticity threshold.

Meanwhile, the degree of rigidity does not change depending on the speed. That is, it has been known that a muscle of a patient exhibits a uniform resistance irrespective of the speed at which the muscle is moved by an external force. For example, when a patient is in a rigidity state, the resistance by the muscle of the patient is substantially unchanged irrespective of whether they try to move the muscle quickly or slowly by using an external force.

By using this fact, a rigidity model can be approximated by the below-shown Expression (2).

$$T_{rigidity}=K\theta+\theta_{offset} \tag{2}$$

In the expression, $T_{rigidity}$ [Nm] is a knee drive torque and θ is a knee rotation angle [deg].

In the expression, K is a coefficient that corresponds to a quotient of a division in which a value of the knee drive torque is dividend and a value of the knee rotation angle is a divisor. Further, $\theta_{offset}$ is a coefficient corresponding to a remainder of the aforementioned division. A first rigidity threshold (a positive value) which is a threshold for determining whether or not a walking trainee is in a rigidity state is set to the aforementioned coefficient K. Further, a second rigidity threshold (a positive value) which is also a threshold for determining whether or not a walking trainee is in a rigidity state is set to the aforementioned coefficient $\theta_{offset}$. The determination unit 333 determines that a walking trainee is in a rigidity state when the absolute value of the value of the coefficient K exceeds the first rigidity threshold or when the absolute value of the value of the coefficient $\theta_{offset}$ exceeds the second rigidity threshold.

Note that the spasticity threshold and the first and second rigidity thresholds can be determined, for example, as shown below.

It is possible to determine these thresholds, which are used in a walking training to be performed at that moment by a walking trainee, by referring to walking data obtained at the time when rigidity or spasticity occurred in a walking training performed in the past by that walking trainee.

Alternatively, these thresholds can be determined by referring to walking data obtained at the time when rigidity or spasticity occurred in walking trainings performed in the past by a number of walking trainees.

Alternatively, a physical therapist or the like present near the walking trainee can set desirable values as appropriate on the spot.

However, the above-described methods for determining the spasticity threshold and the first and second rigidity thresholds are merely an example. That is, the methods are not limited to the above-described examples.

Methods for deriving the coefficient D in the spasticity model expressed by Expression (1) and the coefficients K and $\theta_{offset}$ in the rigidity model expressed by Expression (2) are explained hereinafter in a concrete manner.

Firstly, a method for deriving the coefficient D in the spasticity model expressed by Expression (1) is explained.

Figure 5:
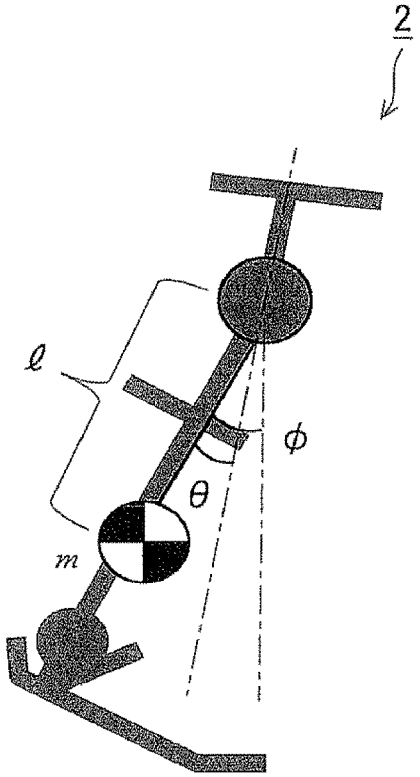
FIG. 5 shows a perspective view schematically showing an example of a leg robot according to the first and second exemplary embodiments of the present invention.

Step 1:

For example, a simplified leg robot 2 shown in FIG. 5 is assumed. In FIG. 5, θ is a knee rotation angle; φ is an angle of a lower limb relative to the gravitational direction; m is a mass of the lower limb at the center of gravity thereof; and 1 is a distance between a knee joint and the center of gravity of the lower limb.

Note that a resistance model of the leg robot 2 when it is not attached to a walking trainee can be expressed by the below-shown Expression (3).

$$T = I\ddot{\theta} + R\dot{\theta} + F\mathrm{sgn}\dot{\theta} + mgl\sin\phi \tag{3}$$

-continued $$= I\ddot{\theta} + R\dot{\theta} + F\mathrm{sgn}\ddot{\theta} + K_1\sin\theta + K_2\cos\theta$$

In Expression (3), T is a torque by which a knee joint is driven; I is a moment of inertia; R is a viscous drag; F is a coefficient of kinetic friction; and g is a gravitational acceleration. Further, $K_1$ and $K_2$ satisfy the following relation.

$$\sqrt{K_1^2 + K_2^2} = mgl,\ \cos(\phi - \theta) = \frac{K_1}{\sqrt{K_1^2 + K_2^2}},\ \sin(\phi - \theta) = \frac{K_2}{\sqrt{K_1^2 + K_2^2}}$$

The determination unit 333 obtains the torque T in Expression (3) in advance by identifying (or determining) the aforementioned I, D, F, $K_1$ and $K_2$.

Step 2:

Next, the determination unit 333 calculates a torque T3 by subtracting a torque T2 from a torque T1 (T3=T1−T2), where T1 represents the knee drive torque obtained during the leg-idling period in the gait motion of the walking trainee and T2 represents the torque T obtained in Expression (3). This torque T3 is the torque used for the calculation of the spasticity model.

Figure 6:
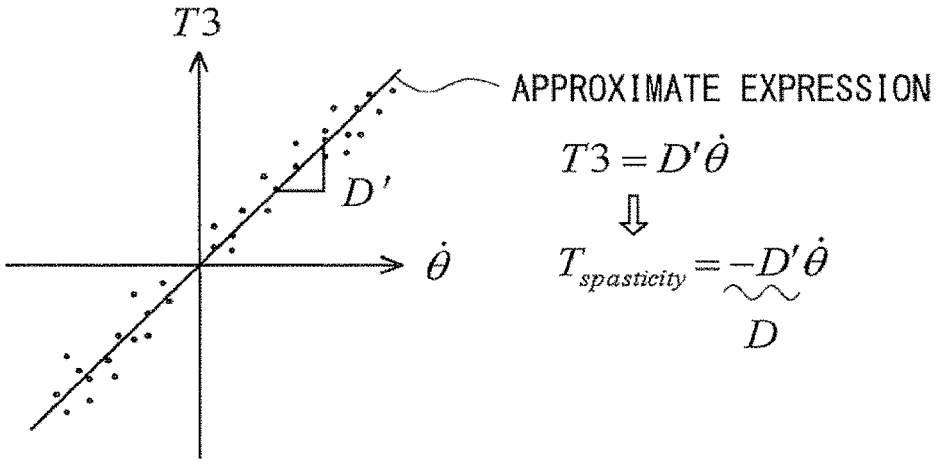
FIG. 6 is a graph showing an example of a method for deriving a coefficient in a spasticity model.

Step 3:

Next, as shown in FIG. 6, the determination unit 333 plots values of $\dot{\theta}$ and values of T3, both of which are obtained during the leg-idling period in the gait motion of the walking trainee, on a graph in which the horizontal axis indicates $\dot{\theta}$ and the vertical axis indicates T3. As a result, an approximate expression expressed as the below-shown Expression (4) is obtained.

$$T3 = D'\dot{\theta} \quad (4)$$

Since the knee drive torque is a reactive force, the determination unit 333 replaces Expression (4) with the below-shown Expression (5).

$$T_{spasticity} = -D\dot{\theta} \quad (5)$$

The determination unit 333 derives "−D" in Expression (5) as the coefficient D in the spasticity model expressed by Expression (1).

Further, the determination unit 333 determines that the walking trainee is in a spasticity state when the absolute value of the value of the coefficient D in the spasticity model expressed by Expression (1) exceeds the spasticity threshold. Therefore, the larger the absolute value of the value of the coefficient D becomes, the more likely it will be determined that the walking trainee is in a spasticity state.

Next, a method for deriving the coefficients K and $\theta_{offset}$ in the rigidity model expressed by Expression (2) is explained.

Step 1:

Similarly to the step 1 of the spasticity model, the determination unit 333 obtains the torque T in Expression (3) in advance.

Step 2:

Next, similarly to the step 2 for the spasticity model, the determination unit 333 calculates a torque T3 by subtracting a torque T2 from a torque T1 (T3=T1−T2). This torque T3 is the torque used for the calculation of the rigidity model.

Figure 7:
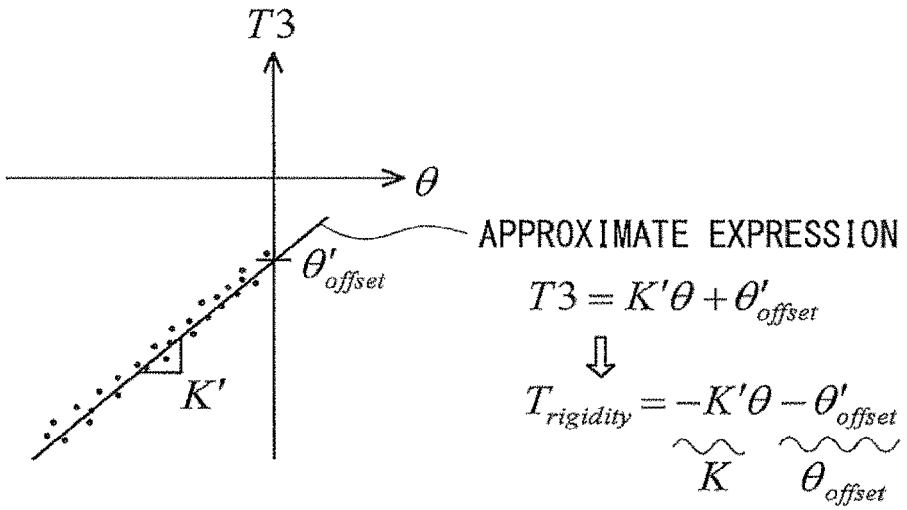
FIG. 7 is a graph showing an example of a method for deriving a coefficient in a rigidity model.

Step 3:

Next, as shown in FIG. 7, the determination unit 333 plots values of θ and values of T3, both of which are obtained during the leg-idling period in the gait motion of the walking trainee, on a graph in which the horizontal axis indicates θ and the vertical axis indicates T3. As a result, an approximate expression expressed as the below-shown Expression (6) is obtained.

$$T3 = K'\theta + \theta'_{offset} \quad (6)$$

Since the knee drive torque is a reactive force, the determination unit 333 replaces Expression (6) with the below-shown Expression (7).

$$T_{rigidity} = -K'\theta - \theta'_{offset} \quad (7)$$

The determination unit 333 derives "−K" and "$-\theta'_{offset}$" in Expression (7) as the coefficients K and $\theta_{offset}$, respectively, in the rigidity model expressed by Expression (2).

Further, the determination unit 333 determines that the walking trainee is in a rigidity state when the absolute value of the value of the coefficient K in the rigidity model expressed by Expression (2) exceeds the first rigidity threshold or the absolute value of the value of the coefficient $\theta_{offset}$ in the rigidity model expressed by Expression (2) exceeds the second rigidity threshold. Therefore, the larger the absolute value of the value of the coefficient K becomes, the more likely it will be determined that the walking trainee is in a rigidity state. Further, the larger the absolute value of the value of the coefficient $\theta_{offset}$ becomes, the more likely it will be determined that the walking trainee is in a rigidity state.

Figure 8:
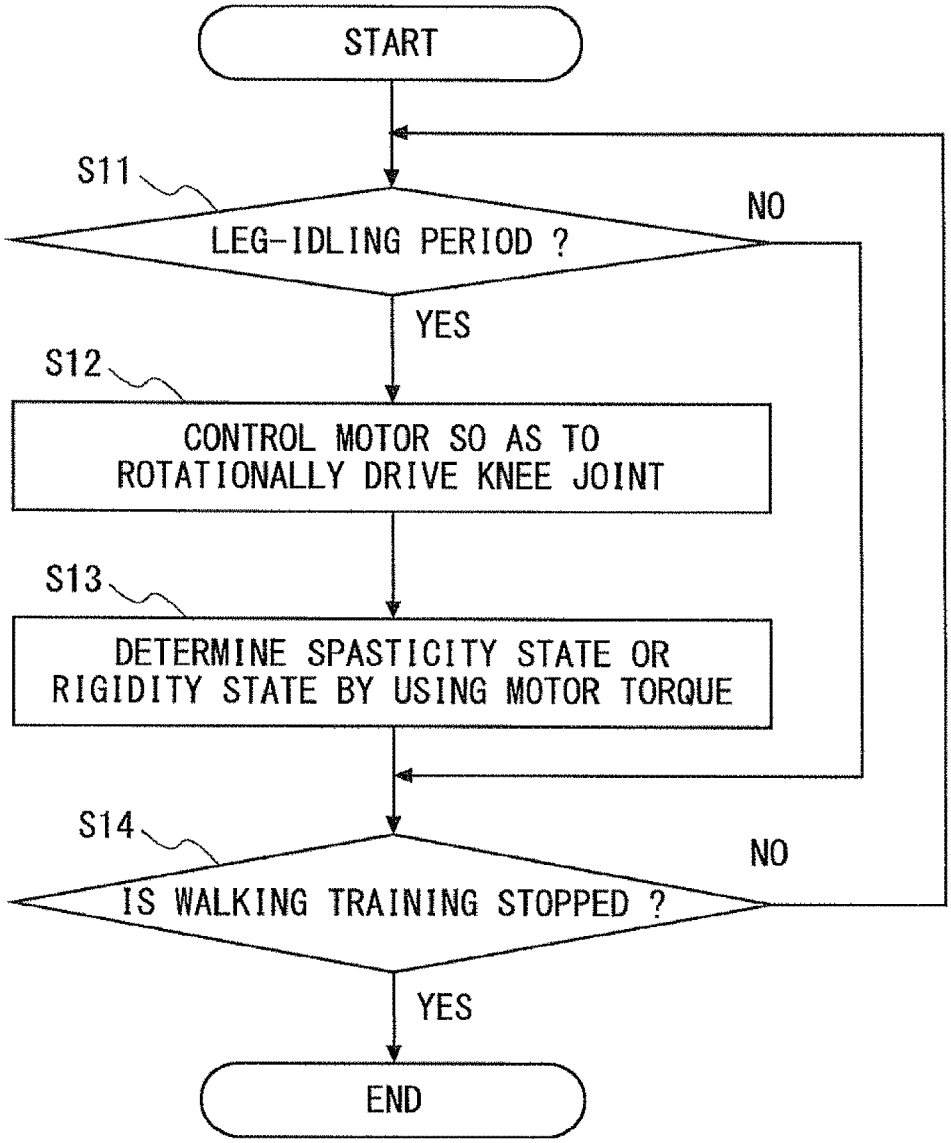
FIG. 8 is a flowchart showing an example of a schematic flow of a state determination method in a walking training apparatus according to the first exemplary embodiment of the present invention.

FIG. 8 is a flowchart showing an example of a state determination method for determining whether or not a walking trainee is in a spasticity state or a rigidity state in the walking training apparatus 1 according to the first exemplary embodiment.

A walking trainee, a physical therapist, or the like starts a walking training by operating an operation unit (not shown). As the walking training is started, the determination unit 333 determines whether or not the trainee's leg is in a leg-idling period in a gait motion of the walking trainee (step S11). When the trainee's leg is not in the leg-idling period (No at step S11), the process proceeds to a step S14 described below.

In the step S11, when the trainee's leg is in the leg-idling period of the gait motion of the walking trainee (Yes at step S11), the control unit 332 controls the motor 261 so that the motor 261 rotationally drives the knee joint 22 in order to assist the walking trainee to walk (step S12).

Next, the determination unit 333 determines whether or not the walking trainee is in a spasticity state or a rigidity state by using a value of a motor torque detected by the motor torque detection unit 262 during the leg-idling period (step S13).

Next, the determination unit 333 determines whether or not the walking training is stopped (step S14) When the walking trainee or a physical therapist or the like present near the walking trainee stops the walking training, he/she stops the walking training by operating the operation unit (not shown). Therefore, the determination unit 333 may determine whether or not the walking training is stopped based on whether or not an operation for stopping the walking training has been performed.

In the step S14, when the walking training is stopped (Yes at step S14), the process is finished. On the other hand, when the walking training is not stopped (No at step S14), the process returns to the process in the step S11.

As described above, according to the first exemplary embodiment, the determination unit 333 determines whether or not a walking trainee is in a spasticity state or a rigidity state by using a value of a motor torque detected by the motor torque detection unit 262 during a leg-idling period of a gait motion of the walking trainee. As a result, it is possible to determine whether or not the walking trainee is in the spasticity state or the rigidity state while the walking trainee is performing the walking training.

Further, the use of the value of the motor torque for the determination of whether a patient is in the spasticity state or the rigidity state is limited to the leg-idling period in the gait motion of the walking trainee and the the value of the motor torque is not used during a leg-standing period. As a result, it is possible to make the determination whether the patient is in the spasticity state or the rigidity state without being affected by the load that the leg of the walking trainee receives from the floor due to the landing that occurs when the leg is in the leg-standing state, thus making it possible to make the determination of whether the patient is in the spasticity state or the rigidity state with high accuracy.

(2) Second Exemplary Embodiment

The external appearance of a walking training apparatus 1' according to a second exemplary embodiment is similar to that of the walking training apparatus 1 according to the first exemplary embodiment shown in FIGS. 1 and 2, but its functional block configuration differs from that of the walking training apparatus 1 according to the first exemplary embodiment.

Figure 9:
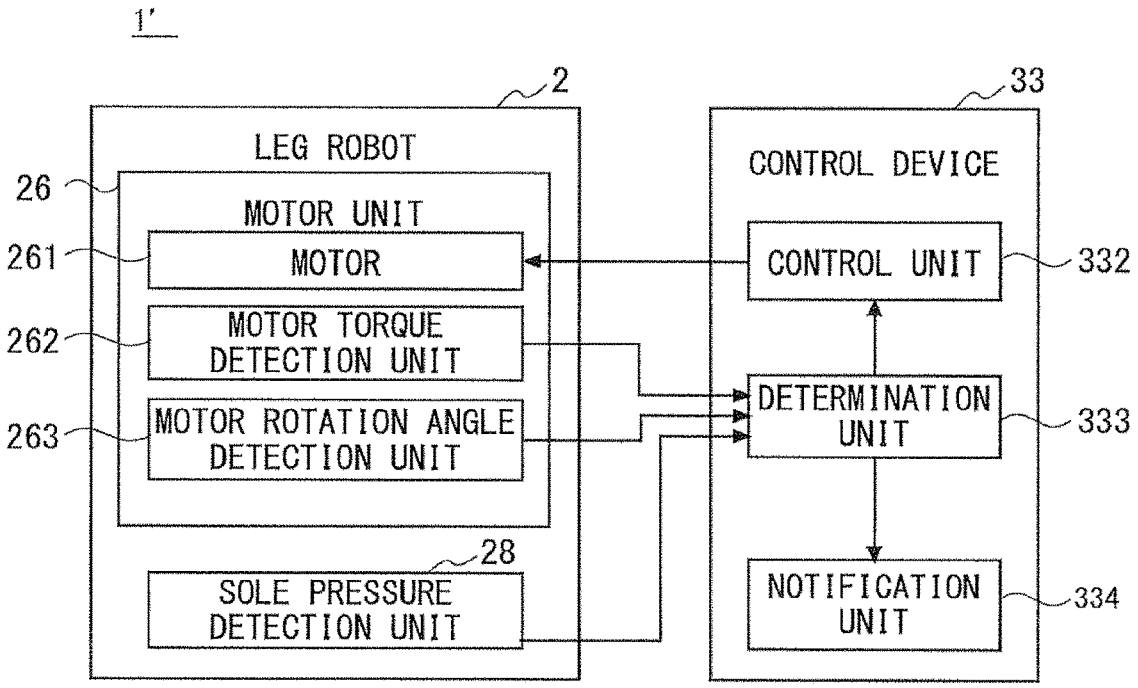
FIG. 9 is a block diagram showing an example of a schematic functional block configuration of a walking training apparatus according to the second exemplary embodiment.

FIG. 9 is a block diagram showing an example of a schematic functional block configuration of the walking training apparatus 1' according to the second exemplary embodiment. In the walking training apparatus 1' according to the second exemplary embodiment, a notification unit 334 is added in the control device 33.

When the determination unit 333 determines that a walking trainee is in a spasticity state or a rigidity state, the notification unit 334 notifies the walking trainee or a physical therapist or the like present near the walking trainee that the walking trainee is in the spasticity state or the rigidity state. Any arbitrary notification method can be used as the notification method. For example, the notification unit 334 may display an image or the like indicating that the walking trainee is in a spasticity state or a rigidity state in the display unit 331. Further, the notification unit 334 may output a voice message indicating that the walking trainee is in a spasticity state or a rigidity state from a voice output unit such as a speaker. Further, the notification unit 334 may output an alarm such as a buzzer sound instead of outputting the voice message.

Figure 10:
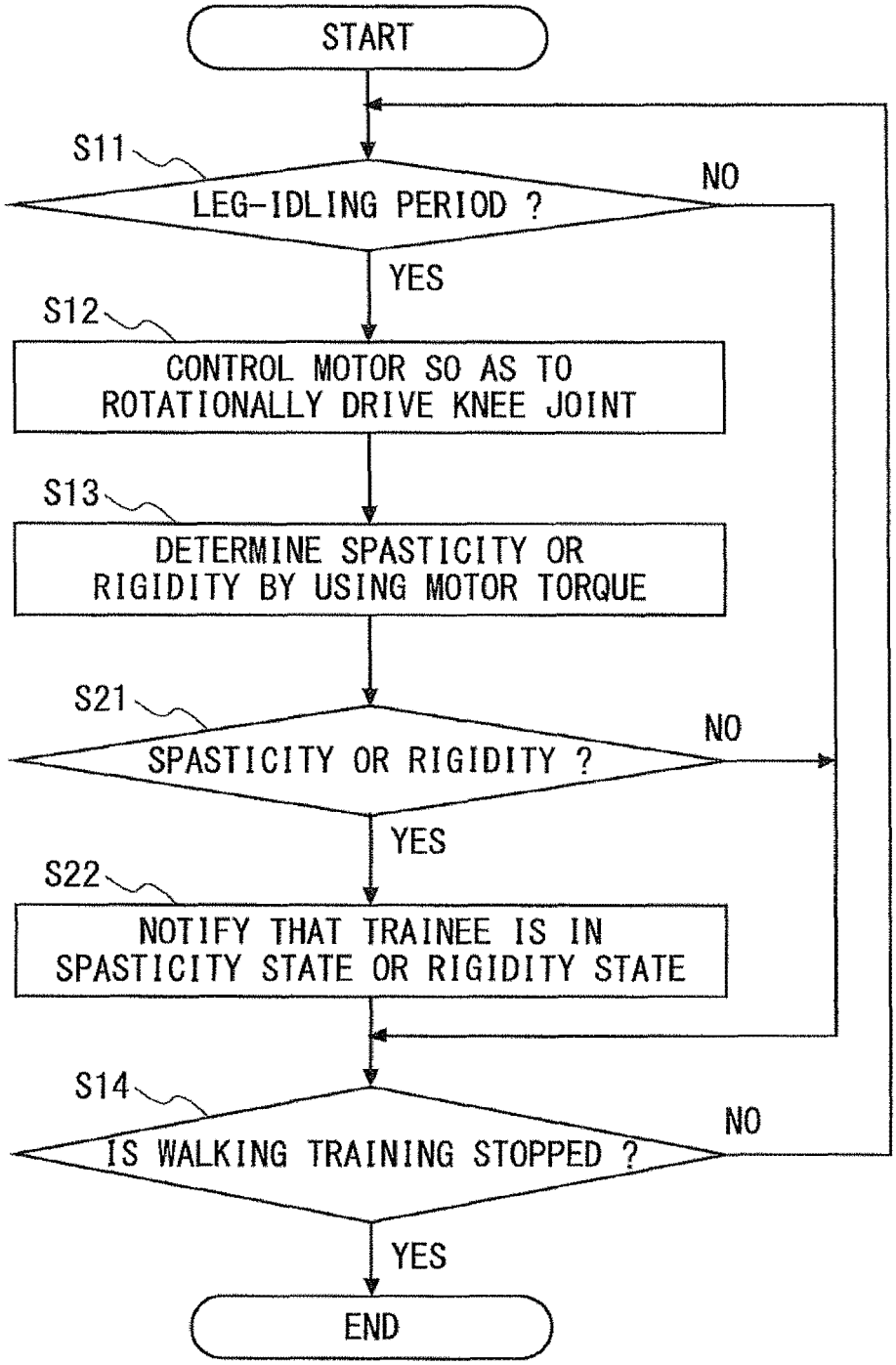
FIG. 10 is a flowchart showing an example of a schematic flow of a state determination method in a walking training apparatus according to the second exemplary embodiment of the present invention.

FIG. 10 is a flowchart showing an example of a state determination method for determining whether or not a walking trainee is in a spasticity state or a rigidity state in the walking training apparatus 1' according to the second exemplary embodiment.

Firstly, steps S11 to S13, which are similar to those in the first exemplary embodiment shown in FIG. 8, are performed.

Next, the notification unit 334 determines whether or not the determination unit 333 has determined that the walking trainee is in a spasticity state or a rigidity state in the immediately preceding step S13 (step S21). When the determination unit 333 has not determined that the walking trainee is in the spasticity state or the rigidity state (No at step S21), the process proceeds to a step S14 (which is described later).

When it is determined that the walking trainee is in a spasticity state or a rigidity state in the step S21 (Yes at step S21), the notification unit 334 provides a notification that the walking trainee is in the spasticity state or the rigidity state (step S22). As described above, examples of conceivable notification method include displaying an image or the like in the display unit 331, outputting a voice message from a voice output unit such as a speaker, outputting an alarm such as a buzzer sound, etc.

After that, a step S14 similar to that of the first exemplary embodiment shown in FIG. 8 is performed.

As described above, according to the second exemplary embodiment, when the determination unit 333 determines that a walking trainee is in a spasticity state or a rigidity state, the notification unit 334 provides a notification about that determination. As a result, the walking trainee or a physical therapist or the like present near the walking trainee can recognize that the walking trainee is in the spasticity state or the rigidity state.

Note that the other effects of the second exemplary embodiment are similar to those of the first exemplary embodiment.

Note that the present invention is not limited to the above-described exemplary embodiments, and various modifications can be made without departing from the spirit and scope of the present invention.

For example, in the above-described exemplary embodiment, only one threshold for the sole load is set and a period from the first timing when the sole load decreases beyond the threshold to the second timing when the sole load exceeds the threshold is determined (or defined) as the leg-idling period. However, the method for determining a leg-idling period is not limited to this example.

For example, two thresholds, i.e., a first threshold and a second threshold smaller than the first threshold may be defined as thresholds for the sole load. Then, a period from a first timing when the sole load decreases beyond the first threshold to a second timing when the sole load exceeds the second threshold may be determined as a leg-idling period. When the second threshold, by which the end of the leg-idling period is determined, is increased, it will not be determined that the leg-idling period is finished unless the walking trainee steps on the floor somewhat strongly as he/she stands on the leg. However, if the walking trainee steps on the floor strongly as he/she stands on the leg, the sole load could possibly be measured as a small value due to its reaction or the like. As a result, it could be falsely determined that a leg-idling period is started even though the leg is actually in the leg-standing state. Consequently, the walking training apparatus could malfunction and start a process for assisting the walking trainee to walk during the false leg-idling period. To prevent such a situation, the second threshold, by which the end of the leg-idling period is determined, is preferably set to a small value.

Alternatively, only one threshold for the sole load may be used as in the case of the above-described exemplary embodiments. Then, a period from a first timing when the sole load decreases beyond the threshold to a second timing that is a predetermined time after the first timing may be determined (or defined) as a leg-idling period. The predetermined time corresponds to a time period from a timing when the walking trainee starts bending his/her knee to a timing when, after the knee rotation angle reaches a set value, the walking trainee stretches his/her knee. When the sole load is lower than the threshold even after the predetermined time has elapsed, it is presumed that the walking trainee is not in the leg-standing state and has his/her leg in the stretched state after the predetermined time has elapsed. However, even when walking data in that state is obtained, it is impossible to determine whether or not the walking trainee is in the spasticity state or the rigidity state and hence the walking data is meaningless. Therefore, only the above-described predetermined time period is determined as the leg-idling period and the spasticity state or the rigidity state is determined in that leg-idling period.

Further, although the walking training apparatus is configured to be capable of determining both a spasticity state and a rigidity state of a walking trainee in the above-described exemplary embodiments, the configuration of the walking training apparatus is not limited to this example. A walking training apparatus according to the present invention may be configured to be able to determine only one of a spasticity state and a rigidity state of a walking trainee.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A walking training apparatus comprising:

a leg robot attached to a leg of a walking trainee;

a motor configured to rotationally drive a knee joint of the leg robot;

controller configured to control the motor so that the motor rotationally drives the knee joint in a leg-idling period in a gait motion of the walking trainee;

motor torque detection unit configured to detect a motor torque, the motor torque being a torque generated by the motor; and determination unit configured to determine whether or not the walking trainee is in a spasticity state or a rigidity state by using a value of the motor torque detected by the motor torque detection unit in the leg-idling period.

2. The walking training apparatus according to claim 1, further comprising motor rotation angle detection unit configured to detect a motor rotation angle, the motor rotation angle being a rotation angle of the motor, wherein the determination unit:

is configured to calculate a knee rotation angle or a knee rotation angular speed during the leg-idling period by using a value of the motor rotation angle detected by the motor rotation angle detection unit during the leg-idling period, the knee rotation angle being a rotation angle of the knee joint, the knee rotation angular speed being a rotation angular speed of the knee joint, and is configured to determine whether or not the walking trainee is in the spasticity state or the rigidity state by using a value of the motor torque during the leg-idling period and a value of the knee rotation angle or the knee rotation angular speed during the leg-idling period.

3. The walking training apparatus according to claim 2, wherein when an absolute value of a value corresponding to a quotient of a division in which the value of the motor torque during the leg-idling period is a dividend and the value of the knee rotation angular speed during the leg-idling period is a divisor exceeds a first rigidity threshold or an absolute value of a value corresponding to a remainder of the division exceeds a second rigidity threshold, the determination unit is configured to determine that the walking trainee is in the rigidity state, the first and second rigidity thresholds being thresholds for determining whether the walking trainee is in the rigidity state.

4. The walking training apparatus according to claim 2, wherein when an absolute value of a value corresponding to a quotient of a division in which the value of the motor torque during the leg-idling period is a dividend and the value of the knee rotation angular speed during the leg-idling period is a divisor exceeds a spasticity threshold, the determination unit is configured to determine that the walking trainee is in the spasticity state, the spasticity threshold being a threshold for determining the spasticity state.

5. The walking training apparatus according to claim 2, wherein the controller is configured to control the motor so that in the leg-idling period, the knee rotation angle monotonously increases until the knee rotation angle reaches a set value and monotonously decreases after the knee rotation angle reaches the set value.

6. The walking training apparatus according to claim 1, further comprising sole load detection unit configured to detect a sole load, the sole load being a load that a sole of the walking trainee receives, wherein the determination unit is configured to determine a period from a first timing to a second timing as the leg-idling period, the first timing being a timing when a value of the sole load detected by the sole load detection unit decreases beyond a first threshold, the second timing being a timing when the sole load detected by the sole load detection unit exceeds a second threshold smaller than the first threshold or a timing a predetermined time after the first timing.

7. A state determination method for determining whether or not a walking trainee is in a spasticity state or a rigidity state in a walking training apparatus by which the walking trainee does a walking training with a leg robot attached to a leg of the walking trainee, the state determination method comprising:

controlling a motor so that the motor rotationally drives a knee joint of the leg robot in a leg-idling period in a gait motion of the walking trainee;

detecting a motor torque in the leg-idling period and determining whether or not the walking trainee is in a spasticity state or a rigidity state by using a value of the motor torque detected in the leg-idling period, the motor torque being a torque generated by the motor.

* * * * *